US010125726B2

(12) United States Patent
Henry

(10) Patent No.: US 10,125,726 B2
(45) Date of Patent: Nov. 13, 2018

(54) APPARATUS AND METHODS FOR EXHAUST GAS RECIRCULATION FOR AN INTERNAL COMBUSTION ENGINE UTILIZING AT LEAST TWO HYDROCARBON FUELS

(71) Applicant: Southwest Research Institute, San Antonio, TX (US)

(72) Inventor: Cary A. Henry, Helotes, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 0 days.

(21) Appl. No.: 14/631,384

(22) Filed: Feb. 25, 2015

(65) Prior Publication Data

US 2016/0245239 A1 Aug. 25, 2016

(51) Int. Cl.
*F02M 26/00* (2016.01)
*F02M 26/35* (2016.01)
(Continued)

(52) U.S. Cl.
CPC ..... *F02M 26/35* (2016.02); *F02M 26/43* (2016.02); *F02M 43/00* (2013.01);
(Continued)

(58) Field of Classification Search
CPC ..... F02D 19/081; F02D 19/0642; F02D 41/0057; F02D 41/0027; F02D 41/0025;
(Continued)

(56) References Cited

U.S. PATENT DOCUMENTS 1,563,608 A * 12/1925 Wood ..... F02M 31/08 123/555
2,113,602 A * 4/1938 Pratt ..... F02B 1/06 123/1 R
(Continued)

FOREIGN PATENT DOCUMENTS

GB 2110791 A 11/1982
JP 11247665 A 9/1999
(Continued)

OTHER PUBLICATIONS

Hacarlioglu, et al; "Studies of the Methane Steam Reforming Reaction At High Pressure in a Ceramic Membrane Reactor"; accessed Sep. 15, 2015 <<http://www.sciencedirect.com/science/article/oii/810039953066001 1X>>.
(Continued)

*Primary Examiner* — Hieu T Vo
*Assistant Examiner* — Sherman Manley
(74) *Attorney, Agent, or Firm* — Grossman, Tucker et al.

(57) ABSTRACT

A method of operating an internal combustion engine having a plurality of cylinders, the method comprising: operating the engine with at least one of the cylinders of the engine as a dedicated exhaust gas recirculation (EGR) cylinder; mixing exhaust gas expelled from the dedicate EGR cylinder with air in an intake system to provide a mixture of exhaust gas and air; providing a first hydrocarbon fuel and a second hydrocarbon fuel; introducing a charge comprising the first hydrocarbon fuel, the second hydrocarbon fuel and the mixture of exhaust gas and air to the dedicated EGR cylinder; igniting the charge in the dedicated EGR cylinder; expelling exhaust gas from the dedicated EGR cylinder; and recirculating the exhaust gas to the intake system of the engine.

20 Claims, 3 Drawing Sheets

(51) Int. Cl.

| | |
|---|---|
| ***F02M 26/43*** | (2016.01) |
| ***F02M 43/00*** | (2006.01) |
| ***F02M 69/04*** | (2006.01) |
| *F02M 26/20* | (2016.01) |
| *F02M 26/36* | (2016.01) |
| *F02M 26/23* | (2016.01) |

(52) U.S. Cl.
CPC ..... *F02M 69/046* (2013.01); *F02M 26/20* (2016.02); *F02M 26/23* (2016.02); *F02M 26/36* (2016.02)

(58) Field of Classification Search
CPC ... F02D 41/0007; F02M 25/0749; F02B 1/12; F02B 3/06; Y02T 10/36; Y02T 10/47
See application file for complete search history.

(56) References Cited

U.S. PATENT DOCUMENTS 3,156,162 A 11/1964 Wallace et al.
3,303,831 A 2/1967 Sherman
3,405,679 A 10/1968 Norris et al.
3,405,697 A 10/1968 Marchand
3,680,534 A 8/1972 Chavant
3,805,752 A 4/1974 Cataldo
3,924,576 A 12/1975 Siewert
3,941,113 A * 3/1976 Baguelin ..... F02B 1/06 123/179.1
3,958,540 A * 5/1976 Siewert ..... F02B 1/06 123/25 A
3,963,000 A * 6/1976 Kosaka ..... C01B 3/38 123/1 A
4,004,554 A * 1/1977 Kosaka ..... F02B 43/10 123/25 R
4,059,076 A 11/1977 Kosaka et al.
4,108,114 A * 8/1978 Kosaka ..... C01B 3/366 123/263
4,131,095 A * 12/1978 Ouchi ..... F02B 1/06 123/3
4,179,892 A * 12/1979 Heydrich ..... F02B 37/00 60/605.2
4,201,180 A 5/1980 Iizuka
4,224,912 A 9/1980 Tanaka
4,350,133 A * 9/1982 Greiner ..... F02B 1/02 123/3
4,735,186 A 4/1988 Parsons
4,783,966 A * 11/1988 Aldrich ..... F01L 13/0015 60/599
5,156,821 A 10/1992 Murayama
5,178,119 A * 1/1993 Gale ..... F02B 41/06 123/568.12
5,207,714 A 5/1993 Hayashi et al.
5,257,600 A 11/1993 Schechter et al.
5,297,515 A * 3/1994 Gale ..... F02M 27/02 123/3
5,343,699 A * 9/1994 McAlister ..... F02B 43/10 123/1 A
5,379,728 A * 1/1995 Cooke ..... F02B 43/08 123/3
5,456,240 A * 10/1995 Kanesaka ..... F01N 13/009 123/565
5,515,814 A * 5/1996 Cooke ..... F02B 43/08 123/3
5,517,976 A * 5/1996 Bachle ..... F01N 3/021 123/568.11
5,524,582 A * 6/1996 Suh ..... F02B 51/02 123/179.15
5,562,085 A * 10/1996 Kosuda ..... F02D 17/02 123/198 F
5,894,726 A 4/1999 Monnier
6,009,709 A * 1/2000 Bailey ..... F01N 3/02 123/568.12
6,138,650 A * 10/2000 Bailey ..... F02B 47/08 123/443
6,178,956 B1 1/2001 Steinmann et al.
6,216,458 B1 4/2001 Alger et al.
6,286,489 B1 * 9/2001 Bailey ..... F02D 41/0047 123/568.11
6,343,594 B1 2/2002 Koeslin et al.
6,397,790 B1 6/2002 Collier, Jr.
6,425,381 B1 7/2002 Rammer
6,478,017 B2 * 11/2002 Bianchi ..... F02M 26/31 123/568.11
6,484,702 B1 11/2002 Riley
6,508,209 B1 1/2003 Collier, Jr.
6,536,392 B2 3/2003 Widener
6,543,230 B1 * 4/2003 Schmid ..... F02D 41/0065 123/568.11
6,543,411 B2 * 4/2003 Raab ..... F02B 1/12 123/299
6,609,374 B2 8/2003 Feucht et al.
6,655,324 B2 12/2003 Cohn et al.
6,672,292 B2 1/2004 Fischer
6,742,507 B2 6/2004 Keefer et al.
6,789,531 B1 * 9/2004 Remmels ..... F02B 47/08 123/357
6,820,415 B2 11/2004 Abet et al.
6,871,642 B1 3/2005 Osterwald
6,877,464 B2 * 4/2005 Hitomi ..... F01L 1/267 123/295
6,877,492 B1 4/2005 Osterwald
6,915,776 B2 * 7/2005 zur Loye ..... F02B 1/12 123/304
6,918,251 B2 7/2005 Yanagisawa et al.
6,923,149 B2 * 8/2005 Nishimoto ..... F01L 1/143 123/58.8
6,945,235 B1 9/2005 Bertilsson et al.
7,028,680 B2 4/2006 Liu et al.
7,032,578 B2 4/2006 Liu et al.
7,140,357 B2 11/2006 Wei et al.
7,168,250 B2 1/2007 Wei et al.
7,232,553 B2 6/2007 Oh et al.
7,261,064 B2 * 8/2007 Bhaisora ..... F02M 25/10 123/179.7
7,290,504 B2 * 11/2007 Lange ..... C01B 3/323 123/1 A
7,384,620 B2 * 6/2008 Bowman ..... B01J 19/18 252/373
7,389,770 B2 6/2008 Bertilsson et al.
7,648,785 B2 * 1/2010 Hu ..... B60L 11/1881 429/412
7,721,541 B2 * 5/2010 Roberts, Jr. ..... F02D 25/00 123/568.11
7,757,677 B2 7/2010 Dobrila
7,779,823 B2 * 8/2010 Winstead ..... F02M 26/43 123/316
7,801,664 B2 * 9/2010 Winstead ..... F02M 26/01 123/198 F
7,818,959 B2 * 10/2010 Hu ..... B60K 6/32 60/274
7,945,376 B2 5/2011 Geyer et al.
7,945,377 B1 5/2011 Van Nieuwstadt et al.
8,100,093 B2 * 1/2012 Morgenstern ..... C01B 3/323 123/1 A
8,291,891 B2 * 10/2012 Alger, II ..... F02D 13/0238 123/315
8,311,723 B2 * 11/2012 McAlister ..... F02B 3/06 123/297
8,387,593 B2 3/2013 Ichihara et al.
8,463,529 B2 * 6/2013 Hu ..... B60K 6/24 60/274
8,557,458 B2 * 10/2013 Scotto ..... H01M 8/04223 429/428
8,561,599 B2 * 10/2013 Gingrich ..... F02M 26/43 123/568.17
8,668,752 B2 * 3/2014 Scotto ..... H01M 8/04223 422/111
8,695,540 B2 * 4/2014 Minick ..... F02M 27/02 123/1 A

(56) References Cited

U.S. PATENT DOCUMENTS 8,752,532 B2 * 6/2014 Korenaga ..... F02D 41/0065 123/568.11
8,838,367 B1 * 9/2014 McAlister ..... F02M 27/04 701/110
8,893,687 B2 11/2014 Gingrich et al.
8,904,786 B2 * 12/2014 Hayman ..... F02B 47/08 123/568.11
8,944,034 B2 * 2/2015 Gingrich ..... F02B 27/0215 123/315
8,966,896 B2 3/2015 Jacques et al.
9,083,020 B2 * 7/2015 Scotto ..... H01M 8/04268
9,091,204 B2 * 7/2015 McAlister ..... F02B 75/02
9,118,048 B2 * 8/2015 Scotto ..... H01M 8/04223
9,140,220 B2 * 9/2015 Scotto ..... F02M 25/12
9,145,837 B2 * 9/2015 Klingbeil ..... F02D 19/081
9,169,773 B2 * 10/2015 Bromberg ..... C01B 3/366
9,178,235 B2 * 11/2015 Scotto ..... H01M 8/04268
9,206,769 B2 12/2015 Burrahm
9,255,560 B2 * 2/2016 McAlister ..... F02B 21/00
9,297,320 B2 3/2016 Hilditch et al.
9,328,697 B2 5/2016 Peters et al.
9,377,105 B2 * 6/2016 McAlister ..... F16J 10/04
9,453,465 B2 9/2016 Bidner et al.
9,464,584 B2 10/2016 Gingrich et al.
9,574,487 B2 * 2/2017 Gruber ..... F02B 19/10
9,611,794 B2 * 4/2017 Blythe ..... F02D 41/0065
9,657,692 B2 5/2017 Chiu
9,797,349 B2 10/2017 Henry
9,874,193 B2 1/2018 Gukelberger et al.
2001/0015193 A1 8/2001 Tanaka et al.
2002/0189598 A1 12/2002 Remmels
2003/0121484 A1 7/2003 Wang
2004/0074480 A1 4/2004 Chen et al.
2004/0099256 A1 5/2004 Stewart
2005/0016792 A1 1/2005 Graefenstein
2005/0022450 A1 2/2005 Tan et al.
2006/0059896 A1 * 3/2006 Liu ..... F01N 3/0253 60/286
2006/0070587 A1 * 4/2006 Bhalsora ..... F02M 25/10 123/3
2006/0112940 A1 * 6/2006 Roberts, Jr. ..... F02D 25/00 123/568.11
2007/0028901 A1 2/2007 Watakabe et al.
2007/0193270 A1 8/2007 Roozenboom et al.
2008/0295501 A1 12/2008 Gong et al.
2009/0120385 A1 * 5/2009 Munshi ..... C10L 3/06 123/3
2009/0199825 A1 * 8/2009 Piper ..... F02D 9/04 123/568.21
2009/0308070 A1 12/2009 Alger, II et al.
2011/0031162 A1 2/2011 Drnevich et al.
2011/0041495 A1 2/2011 Yager
2011/0114037 A1 5/2011 Bates
2011/0146267 A1 6/2011 Hepburn et al.
2012/0006288 A1 * 1/2012 Winstead ..... F02M 26/43 123/58.8
2012/0078492 A1 * 3/2012 Freund ..... F02D 41/0065 701/108
2012/0167863 A1 7/2012 Kulkarni
2012/0204844 A1 8/2012 Gingrich et al.
2012/0204845 A1 8/2012 Gingrich et al.
2012/0216530 A1 8/2012 Flynn et al.
2012/0285426 A1 11/2012 Hayman et al.
2013/0000320 A1 1/2013 McKenna et al.
2013/0030672 A1 * 1/2013 Klingbeil ..... F02D 41/0085 701/109
2013/0133616 A1 * 5/2013 Klingbeil ..... F02D 19/081 123/304
2013/0216473 A1 * 8/2013 Nicole ..... F01N 3/04 423/651
2013/0323145 A1 12/2013 Tran et al.
2014/0196697 A1 7/2014 Burrahm
2014/0196702 A1 7/2014 Gingrich et al.
2014/0223903 A1 8/2014 Keating
2014/0261322 A1 * 9/2014 Geckler ..... F02D 41/0065 123/445
2014/0331668 A1 * 11/2014 Bidner ..... F02D 19/027 60/605.2
2014/0331970 A1 * 11/2014 Bidner ..... F02D 19/0642 123/435
2015/0166913 A1 6/2015 Brody et al.
2015/0361927 A1 * 12/2015 Glugla ..... F02M 25/0749 60/603
2016/0017847 A1 * 1/2016 Hilditch ..... F02D 41/0052 123/406.48
2016/0076488 A1 * 3/2016 Henry ..... F02M 25/074 60/274
2016/0341157 A1 11/2016 Henry
2017/0074214 A1 3/2017 Chiu
2017/0363057 A1 12/2017 Gukelberger et al.

FOREIGN PATENT DOCUMENTS

JP 2004278433 A 10/2004
JP 2005-054605 A 3/2005
JP 2006-336465 A 12/2006
JP 2011099375 A 5/2011
WO 200071881 A1 11/2000
WO 2006052993 A2 5/2006
WO 2010146048 A1 12/2010

OTHER PUBLICATIONS

Hankinson, et al; Ignition Energy and Ignition Probability of Methane-Hydrogen-Air Mixtures; accessed May 30, 2013 <<http://conference.ing.unipi.it/ichs/images/stories/papers/125.pdf>>.
Saxena, et al; "The Influence of Hydrogen and Carbon Monoxide on Structure and Burning Velocity of Methane Flames"; 2009 Fall Technical Meeting of the Western States Section of the Combusion Institute Hosted by the Univ of Cali at Irvine, CA, Oct. 26-27, 2009, Paper #09F-86, 20 pgs; accessed May 20, 2015 <<http://www.engr.ucr.edu/WSSCIConference/Exampleformatpdf>>.
Zanfir, et al; Catalytic Combustion Assisted Methane Steam Reforming in a Catalytic Plate Reactor; Chemical Engineering Science vol. 58, pp. 3947-3960, 2003.
Caterpillar "Application and Installation Guide, Gas Engine Emissions"; © 2007 Caterpillar® (31 pgs).
U.S. Office Action dated Oct. 3, 2016 issued in related U.S. Appl. No. 14/851,890 (8 pgs).
U.S. Office Action dated Feb. 6, 2017 issued in related U.S. Appl. No. 14/718,531 (16 pgs).
U.S. Office Action dated Apr. 6, 2016 issued in U.S. Appl. No. 14/487,463 (21 pgs).
U.S. Office Action dated Oct. 20, 2016 issued in U.S. Appl. No. 14/487,463 (20 pgs).
International Search Report (dated Oct. 2, 2006) issued in International Patent Application No. PCT/US05/40483 (WO2006052993) (5 pgs) .
International Preliminary Report on Patentability/Written Opinion (dated Oct. 2, 2006) issued in International Patent Application No. PCT/US05/40483. (WO2006052993) (7 pgs).
U.S. Office Action dated May 28, 2013 issued in related U.S. Appl. No. 13/025,901 (17 pgs.).
U.S. Office Action dated Dec. 12, 2013 issued in related U.S. Appl. No. 13/025,901 (16 pgs.).
U.S. Office Action dated May 21, 2014 issued in related U.S. Appl. No. 13/025,901 (15 pgs.).
U.S. Office Action dated Mar. 22, 2013 issued in related U.S. Appl. No. 13/025,912 (6 pgs.).
Wu, H. et al., "Ni-Based Catalysts for Low Temperature Methane Stream Reforming: Recent Results on Ni—Au and Comparison with Other Bi-Metallic Systems", Catalysts 2013, vol. 3, pp. 563-583.
Duel Fuel™ Technology, Clean Air Power; "Dual-Fuel vs Spark Ignition"; <<http://www.cleanairpower.com/dualfuelvssparkignition.html>>; (2 pgs) (accessed Oct. 2, 2017).

(56) References Cited

OTHER PUBLICATIONS

U.S. Office Action dated Feb. 5, 2018 issued in related U.S. Appl. No. 14/487,463 (17 pgs).

* cited by examiner

APPARATUS AND METHODS FOR EXHAUST GAS RECIRCULATION FOR AN INTERNAL COMBUSTION ENGINE UTILIZING AT LEAST TWO HYDROCARBON FUELS

FIELD

The present disclosure relates to exhaust gas recirculation for internal combustion engines, and more particularly, to improved exhaust gas recirculation for internal combustion engines powered by hydrocarbon (HC) fuels.

BACKGROUND

For certain conventional exhaust gas recirculation (EGR) systems, exhaust gas expelled from all of the cylinders of an internal combustion engine may be collected in an exhaust manifold. A fraction of the collected exhaust gas (e.g. 5% to 10%) may then be routed from the exhaust manifold through a control valve back to an intake manifold of the engine, where it may be introduced to a stream of fresh (ambient) intake air. The remaining fraction of exhaust gas in the exhaust manifold, rather than being recirculated and recycled, generally flows to a catalytic converter of the exhaust system and, after treatment therein, may be expelled to the atmosphere through the exhaust pipe.

EGR has a history of use in gasoline spark-ignition engines, and affects combustion in several ways. First, the combustion in the cylinders of the engine may be cooled by the presence of exhaust gas, that is, the recirculated exhaust gas may absorb heat from the combustion. Furthermore, the dilution of the oxygen present in the combustion chamber with the exhaust gas, in combination with the cooler combustion, may reduce the production of mono-nitrogen oxides (NOx), such as nitric oxide (NO) and nitrogen dioxide ($NO_2$). Additionally, EGR may reduce the need for fuel enrichment at high loads in turbocharged engines and thereby improve fuel economy.

EGR which uses higher levels of exhaust gas may further increase fuel efficiency and reduce emissions of spark-ignition engines. However, with higher levels of exhaust gas, engines may face challenges related to EGR tolerance, which may reduce the expected fuel efficiency improvement. Challenges related to EGR tolerance may be understood to include increasing an engine's ability to process higher levels of exhaust gas without adversely affecting performance, particularly fuel economy. Thus, even if EGR tolerance may be satisfactory for engine operation at low levels of EGR, an engine may need additional modifications in structure and operational conditions to accommodate higher levels of EGR without adversely affecting engine performance.

More recently, an engine configuration has been proposed with one or more cylinders of the engine being dedicated to expelling exhaust gas for EGR, which is then directed to the intake manifold. Such cylinders may be referred to as dedicated EGR, or D-EGR, cylinders. Dedicated EGR cylinder(s) may operate at a broad range of equivalence ratios since their exhaust gas is generally not configured to exit the engine before flowing through a cylinder operating at, for example, a stoichiometric or near stoichiometric air/fuel ratio. This may allow the dedicated EGR cylinder to be operated fuel rich to produce higher levels of hydrogen ($H_2$) gas and carbon monoxide (CO) gas and which, may in turn, increase the octane number and promote increased EGR tolerance and knock tolerance by increasing flame/speed burn rates, as well as increasing the dilution limits of the mixture and associated combustion stability of all the cylinders. Examples of engines with a D-EGR cylinder may be found in U.S. Patent Application Publication No. 2012/0204844 entitled "Dedicated EGR Control Strategy For Improved EGR Distribution And Engine Performance" and U.S. Patent Application Publication No. 2012/0204845 entitled "EGR Distributor Apparatus For Dedicated EGR Configuration", both in the name of Jess W. Gingrich, which are assigned to the assignee of the present disclosure and hereby incorporated by reference.

SUMMARY

The present disclosure provides various apparatus and methods for treatment of exhaust gas for recirculation in an internal combustion engine which utilizes at least two hydrocarbon fuels, which may be particularly applied to an engine having at least one dedicated exhaust gas recirculation (EGR) cylinder. This disclosure exploits the benefits of different fuel technologies to provide synergistic characteristics not possible with a single fuel. More particularly, by utilizing a primary combustion fuel, such as gasoline, in all the cylinders (including the dedicated EGR cylinder), the rich limit of combustion may be extended, combustion duration may be decreased, and the ignition energy requirement may be reduced. Coupling the injection of the primary fuel in the dedicated (EGR) cylinder with a secondary fuel having a hydrogen to carbon (H:C) atomic ratio which is greater than that of the primary fuel, such as compressed natural gas (CNG), liquefied natural gas (LNG) or liquefied petroleum gas (LPG), provides increased levels of hydrogen ($H_2$) gas in the recirculated exhaust gas which lead to further improvements in fuel efficiency in the engine.

In at least one embodiment, a method of operating an internal combustion engine having a plurality of cylinders is provided, with the method comprising: operating the engine with at least one of the cylinders of the engine as a dedicated exhaust gas recirculation (EGR) cylinder, wherein 90%-100% by volume of exhaust gas expelled from the dedicated EGR cylinder is recirculated to an intake system of the engine; mixing exhaust gas expelled from the dedicate EGR cylinder with air in the intake system of the engine to provide a mixture of exhaust gas and air; providing a first hydrocarbon fuel from a first fuel tank; providing a second hydrocarbon fuel from a second fuel tank; introducing a charge comprising the first hydrocarbon fuel, the second hydrocarbon fuel and the mixture of exhaust gas and air to the dedicated EGR cylinder; igniting the charge in the dedicated EGR cylinder; expelling exhaust gas from the dedicated EGR cylinder; and recirculating the exhaust gas to the intake system of the engine.

In at least one embodiment, the second hydrocarbon fuel has a hydrogen to carbon (H:C) atomic ratio greater than the first hydrocarbon fuel.

In at least one embodiment, the first hydrocarbon fuel is gasoline, and the second hydrocarbon fuel is natural gas or is liquefied petroleum gas.

In at least one embodiment, the second hydrocarbon fuel is added to the mixture of exhaust gas and air provided to the dedicated EGR cylinder by a fuel injector located in an intake manifold of the engine or intake port of the engine.

In at least one embodiment, the method may further comprise introducing a charge comprising the first hydrocarbon fuel and the mixture of exhaust gas and air to each of the remaining cylinders, and wherein the charge introduced to each of the remaining cylinders does not include the second hydrocarbon fuel.

In at least one embodiment, the method may further comprise igniting the charge in each of the remaining cylinders; expelling exhaust gas from each of the remaining cylinders; and treating the exhaust gas expelled from each of the remaining cylinders with a catalytic converter.

In at least one embodiment, during the step of recirculating the exhaust gas to the intake system of the engine, the exhaust gas is routed through a water gas shift reactor; and the exhaust gas undergoes a reaction in the water gas shift reactor, wherein the reaction increases a quantity of hydrogen contained in the exhaust gas.

In at least one embodiment, during the step of recirculating the exhaust gas to the intake system of the engine, the exhaust gas is routed through a steam hydrocarbon reformer; and the exhaust gas undergoes a reaction in the steam hydrocarbon reformer, wherein the reaction increases a quantity of carbon monoxide and hydrogen contained in the exhaust gas.

In at least one embodiment, a motor vehicle is provided, with the motor vehicle comprising an internal combustion engine having a plurality of cylinders; at least one of the cylinders of the engine arranged as a dedicated exhaust gas recirculation (EGR) cylinder, wherein 90%-100% by volume of exhaust gas expelled from the dedicated EGR cylinder is recirculated to an intake system of the engine; a plurality of first fuel injectors to receive a first hydrocarbon fuel from a first fuel tank of the motor vehicle, wherein each of first fuel injectors is arranged to provide the first hydrocarbon fuel to one of each of the cylinders; and a second fuel injector to receive a second hydrocarbon fuel from a second fuel tank of the motor vehicle, wherein the second fuel injector is arranged to provide the second hydrocarbon fuel to the dedicated EGR cylinder.

In at least one embodiment, the engine is arranged such that the second hydrocarbon fuel is only provided to the dedicated EGR cylinder and not the remaining cylinders.

In at least one embodiment, the exhaust gas expelled from the dedicated EGR cylinder is recirculated to the intake system of the engine in an EGR feedback loop; and the engine further comprises a water gas shift reactor located in the EGR feedback loop such that the exhaust gas expelled from the dedicate EGR cylinder is routed through the water gas shift reactor.

In at least one embodiment, the exhaust gas expelled from the dedicated EGR cylinder is recirculated to the intake system of the engine in an EGR feedback loop; and the engine further comprises a steam hydrocarbon reformer located in the EGR feedback loop such that the exhaust gas expelled from the dedicated EGR cylinder is routed through the steam hydrocarbon reformer.

In at least one embodiment, the first fuel injectors are arranged to direct the first fuel directly into each cylinder.

In at least one embodiment, the second fuel injector is arranged in an intake port of the dedicated EGR cylinder or an intake passage of the dedicated EGR cylinder.

In at least one embodiment, the intake port is within a cylinder head of the engine.

In at least one embodiment, the intake passage is located within an intake manifold of the engine.

In at least one embodiment, the first fuel tank is a gasoline fuel tank and the second fuel tank is a natural gas fuel tank or a liquefied petroleum gas fuel tank.

In at least one embodiment, an engine for a motor vehicle is provided, with the engine comprising: a plurality of cylinders; at least one of the cylinders of the engine arranged as a dedicated exhaust gas recirculation (EGR) cylinder, wherein 90%-100% by volume of exhaust gas expelled from the dedicated EGR cylinder is recirculated to an intake system of the engine; a plurality of first fuel injectors to receive a first hydrocarbon fuel from a first fuel tank, wherein each of first fuel injectors is arranged to provide the first hydrocarbon fuel to one of the cylinders; and a second fuel injector to receive a second hydrocarbon fuel from a second fuel tank, wherein the second fuel injector is arranged to provide the second hydrocarbon fuel to the dedicated EGR cylinder.

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1:
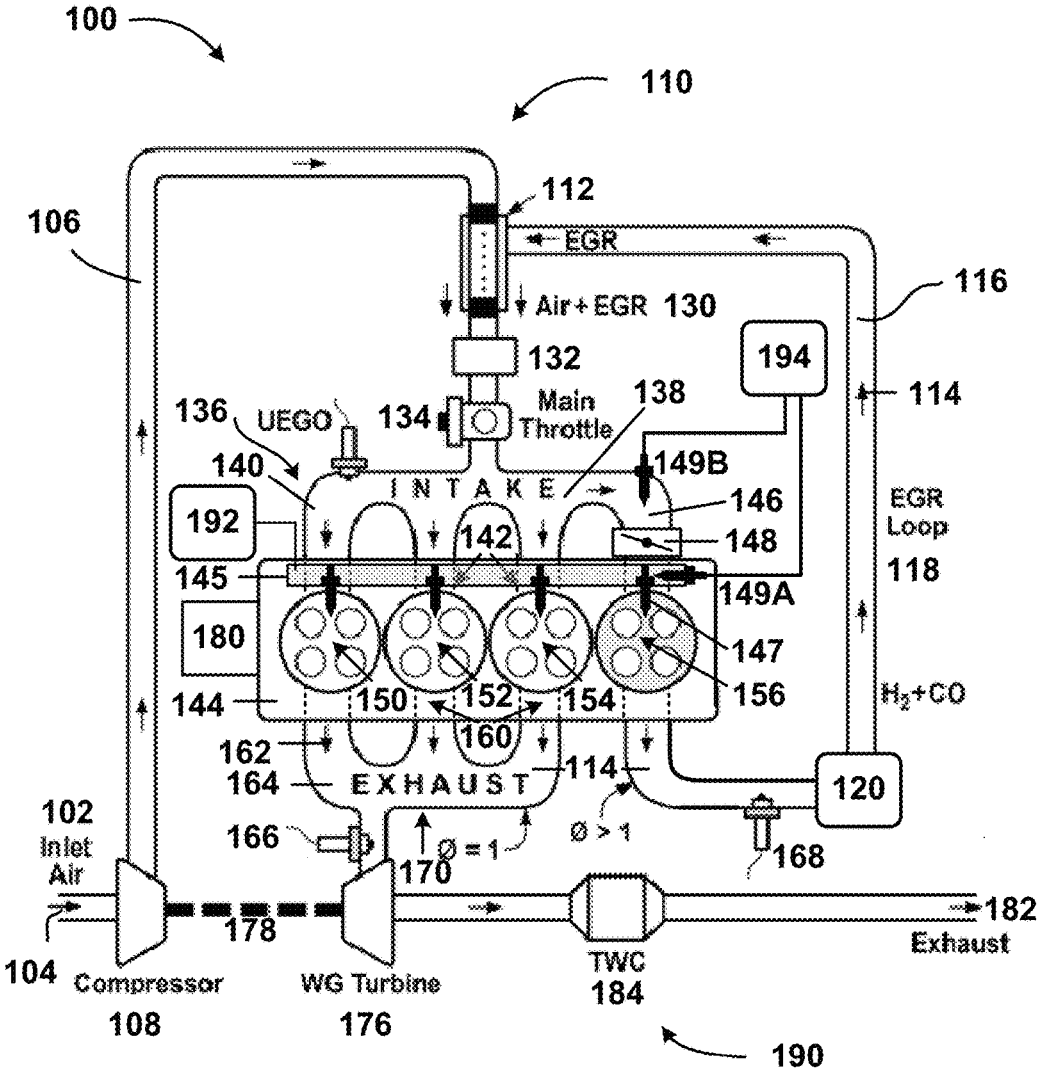
FIG. 1 is a schematic representation of an internal combustion engine having an emissions system, particularly an EGR system. As shown, the engine may utilize fuel from two different fuel sources, and include an EGR apparatus comprising a water gas shift reactor according to a first embodiment of the present disclosure.

It may be appreciated that the present disclosure is not limited in its application to the details of construction and the arrangement of components set forth in the following description or illustrated in the drawings. The invention(s) herein may be capable of other embodiments and of being practiced or being carried out in various ways. Also, it may be appreciated that the phraseology and terminology used herein is for the purpose of description and should not be regarded as limiting as such may be understood by one of skill in the art.

The following description is directed to various configurations of emissions systems, particularly exhaust gas recirculation (EGR) systems, apparatuses and methods to be used with an internal combustion engine, particularly of a motor vehicle such as an automobile. With an EGR system, one or more cylinders of the internal combustion engine may be used to generate exhaust gas, which may then be recirculated and mixed with an intake stream of fresh (ambient) air to provide a mixed charge (mixture) of exhaust gas and air to the cylinders of the engine.

For the purposes of this disclosure, an engine configured such that substantially an entire output of exhaust gas from a cylinder is to be recirculated for EGR may be referred to herein as an engine having a dedicated EGR cylinder.

Referring now to the figures, FIG. 1 illustrates an internal combustion engine 100. Internal combustion engine 100 may power a motor vehicle that utilizes at least two hydrocarbon fuels which have different compositions. The first, or primary fuel, may be gasoline, which may comprise alkanes having four to twelve carbon atoms (e.g. butane ($C_4H_{10}$), pentane ($C_5H_{12}$), hexane ($C_6H_{14}$), heptane ($C_7H_{16}$), octane ($C_8H_{18}$), nonane ($C_9H_{20}$), decane ($C_{10}H_{22}$), undecane ($C_{11}H_{24}$) and dodecane ($C_{12}H_{26}$)). The second, or secondary fuel, may have a hydrogen to carbon (H:C) atomic ratio which is greater than that of the primary fuel. For example, gasoline may be understood to have a H:C ratio of about 1.86. In contrast, if secondary fuel is formed exclusively of methane ($CH_4$) or propane ($C_3H_8$), the secondary fuel may be understood to have a H:C atomic ratio of 4.0 or 2.67, respectively.

Secondary fuel may be natural gas, either as compressed natural gas (CNG) or liquefied natural gas (LNG). Natural gas may comprise 80%-99% methane ($CH_4$) gas, with liquefied natural gas (LNG) having more methane ($CH_4$) gas than compressed natural gas (CNG). Other components of natural gas may include ethane ($C_2H_6$), propane ($C_3H_8$), butane ($C_4H_{10}$), pentane ($C_5H_{12}$), nitrogen ($N_2$), carbon dioxide (CO), oxygen ($O_2$) and hydrogen ($H_2$). The secondary fuel may also be liquefied petroleum gas (LPG), such as liquefied propane ($C_3H_8$) and/or liquefied butane ($C_4H_{10}$).

As such, internal combustion engine 100 may be a dual fuel engine which is configured to operate with both gasoline and natural gas being used as fuels simultaneously.

Internal combustion engine 100 is shown to have four cylinders 150, 152, 154 and 156, although such is not intended to limit the present disclosure. One of the cylinders, cylinder 156, may be understood to be a dedicated EGR cylinder. In other words, it may be understood that substantially all of the exhaust gas 114 expelled from cylinder 156 may be directed (recirculated) back to the intake system 110, here through an EGR feedback loop 118. The exhaust gas from the remaining three cylinders 150, 152, and 154 is directed to an exhaust system 190, with none of the exhaust gas expelled from cylinders 150, 152 and 154 recirculated to the intake system 110 of engine 100.

While it may be possible, based on the configuration of engine 100, for all of the exhaust gas (i.e. 100%) expelled from cylinder 156 to be optimally recirculated back to the intake system 110, it should be understood that certain design considerations and operating inefficiencies may only allow a substantial portion of the exhaust gas expelled from cylinder 156 to be recirculated back to the intake system 110. For example, exhaust gas losses may occur between connection points. Accordingly, it is contemplated that on a volume basis, 90% or more of the exhaust gas expelled from the dedicated EGR cylinder is recirculated to the engine intake system 110. More preferably, 90-100% of the exhaust gas expelled from cylinder 156 is recirculated, including all values therein, in 0.1% by volume increments.

Furthermore, with four cylinders of equal volume, engine 100 may also be understood to have a nominal "25% dedicated EGR content" because the exhaust gas expelled from each cylinder may be understood to have substantially the same volume, and one of the four cylinders has 100% of its exhaust gas redirected to the intake system 110, as noted above. The actual EGR content can vary depending on differences in cylinder head pressure drop from cylinder to cylinder.

During an operation of engine 100, fresh (ambient) intake air 102 may enter air inlet 104 of air intake system 110. The air 102 may then travel within intake passage 106, during which time it may be compressed by intake compressor 108. Thereafter, air 102 may enter air/exhaust gas mixer 112 of air intake system 110, and more particularly as distribution mixer, which is configured to distribute and mix the recirculated and exhaust gas 114 into the stream of air 102 to be introduced to the internal combustion engine 100.

As shown by FIG. 1, each of cylinders 150, 152, 154 and 156 may receive the primary (first) hydrocarbon fuel, such as gasoline, from a fuel (common) rail 145 which is in fluid communication with a first fuel tank 192. Gasoline may be provided to each cylinder 150, 152, 154 and 156 from the fuel rail 145 by a direct fuel injector 147 located in each cylinder 150, 152, 154 and 156

In addition to the foregoing, dedicated EGR cylinder 156 may receive the secondary (second) hydrocarbon fuel, such as natural gas (compressed or liquefied) or liquefied petroleum gas, from a second fuel injector 149 in fluid communication with a second fuel tank 194. As shown, the second fuel injector 149A may be located in the intake port 142 of the cylinder head 144 (i.e. port fuel injection) dedicated to cylinder 156, or as shown at 149B in an intake passage 146 of the intake manifold 136 dedicated to cylinder 156. In either situation, the second fuel injector 149A or 149B is arranged to provide substantially all the fuel (90%-100% by volume) to the dedicated EGR cylinder 156, and not cylinders 150, 152 or 154. Thus, it may be understood that dedicated EGR cylinder 156 operates with a charge comprising the first hydrocarbon fuel, the second hydrocarbon fuel and the mixture of exhaust gas and air to the dedicated EGR cylinder, while the remaining cylinders are operated with a charge that does not include the second hydrocarbon fuel (i.e. 0% by volume) or includes such fuel only at a maximum level of up to 10% by volume.

Dedicated EGR cylinder 156 may be operated fuel rich (i.e. fuel-air equivalence ratio phi ($\Phi$) is greater than 1.0) to produce exhaust gas 114 with carbon monoxide (CO) gas and hydrogen ($H_2$) gas which, may in turn, increase the octane number and promote increased EGR tolerance and knock tolerance by increasing flame/speed burn rates, as well as increasing the dilution limits of the mixture and associated combustion stability of all the cylinders.

It may be understood that the production of exhaust gas 114 with carbon monoxide (CO) gas and hydrogen ($H_2$) gas is the result of incomplete combustion of the fuel being provided to dedicated EGR cylinder 156, which may be expressed by the following reaction:

$$C_xH_y+zO_2 \rightarrow aCO_2+bCO+cH_2O+dH_2 \quad \text{(Eq 1)}$$

While incomplete combustion of fuel in dedicated EGR cylinder 156, and the resultant production of carbon monoxide (CO) gas and hydrogen ($H_2$) gas, may be achieved by operating dedicated EGR cylinder 156 solely with the primary fuel such as gasoline, the concentration of hydrogen ($H_2$) gas in the exhaust gas 114 may be increased by operating dedicated EGR cylinder 156 with the secondary fuel, such as natural gas or petroleum gas, simultaneously with the primary fuel. As set forth above, the secondary fuel has a hydrogen to carbon (H:C) atomic ratio which is greater than that of the primary fuel and, consequently, provide higher levels of hydrogen ($H_2$) gas in the exhaust gas 114 than the primary fuel when used alone.

Alternatively, while incomplete combustion of fuel in dedicated EGR cylinder 156, and the resultant production of carbon monoxide (CO) gas and hydrogen ($H_2$) gas, may be achieved by operating dedicated EGR cylinder 156 solely with the secondary fuel, fuels such as natural gas or petroleum gas may be understood to have slower burning velocities, higher ignition energy requirements and reduced rich combustion limits. As such, while it is possible herein to operate dedicated EGR cylinder 156 solely with a secondary fuel such as natural gas or petroleum gas, the foregoing deficiencies encountered in doing such make it less desirable.

Figure 2:
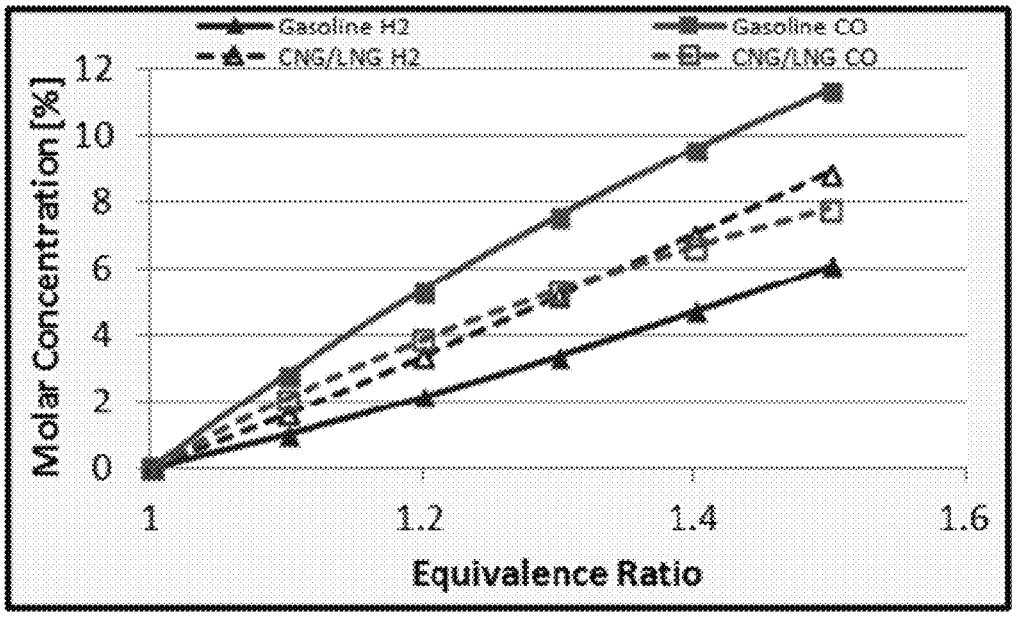
FIG. 2 is a graphical representation of the molar concentration of hydrogen ($H_2$) gas and carbon monoxide (CO) gas contained in exhaust gas from gasoline and natural gas (which may be either compressed natural gas (CNG) or liquefied natural gas (LNG)) at different equivalence ratios.

By using a dual fuel approach to provide exhaust gas enrichment to the dedicated EGR cylinder 156, it is possible to now make efficient use of the increased rich combustion limits of the primary fuel, such as gasoline, and the increased H:C ratio of the secondary fuel, such as natural gas or petroleum gas. Referring now to FIG. 2, FIG. 2 shows hydrogen ($H_2$) gas and carbon monoxide (CO) gas emissions as a function of the fuel-air equivalence ratio for both gasoline and natural gas (e.g. CNG or LNG) fuels. The higher H:C atomic ratio of the natural gas (CNG/LNG) results in a higher concentration of hydrogen ($H_2$) gas in the exhaust gas stream than with gasoline. Assuming constant adiabatic flame temperature, hydrogen ($H_2$) gas content present from the rich combustion of natural gas (CNG/LNG) is 50% higher than gasoline.

Now, while carbon monoxide (CO) gas production is 33% lower when natural gas (CNG/LNG) in used place of gasoline, and both hydrogen ($H_2$) gas and carbon monoxide (CO) gas have been shown to improve knock tolerance and combustion duration of dilute gasoline engines, the benefits of hydrogen ($H_2$) gas for both knock tolerance and combustion duration are observed to be much greater than carbon monoxide (CO) gas. Therefore, increasing hydrogen ($H_2$) gas concentration at the expense of a reduction in carbon monoxide (CO) gas concentration results in a net improvement in fuel efficiency of the dedicated EGR engine 100.

After exiting dedicated EGR cylinder 156, exhaust gas 114 from dedicated EGR cylinder 156 will enter passage 116 of EGR feedback loop 118. Thereafter, exhaust gas 114 will enter mixer 112 of the air intake system 110 and be mixed with a stream of air 102 to provide a mixture 130 of air 102 and exhaust gas 114. As explained herein, exhaust gas 114 from dedicated EGR cylinder 156 may be treated within the EGR feedback loop 118 after exiting EGR cylinder 156 and prior to mixing with air 102.

To further increase the quantity of hydrogen ($H_2$) gas in exhaust gas 114 after leaving the dedicated EGR cylinder 156, prior to entering mixer 112 the untreated exhaust gas 114 may enter a water gas shift reactor 120 within the EGR feedback loop 118. Upon entering the water gas shift reactor 120, one or more components of the exhaust gas 114 may react with water ($H_2O$) vapor using a water gas shift reaction (WGSR) with a suitable water gas shift (WGS) catalyst contained in a water gas shift reactor 120. More particularly, with the WGS reaction, carbon monoxide (CO) gas in the exhaust gas 114 may react with water ($H_2O$) vapor to produce carbon dioxide ($CO_2$) gas and hydrogen ($H_2$) gas according to the following reaction:

$$CO+H_2O \rightarrow CO_2+H_2 \quad \text{(Eq 2)}$$

Reacting carbon monoxide (CO) gas in the exhaust gas 114 with water ($H_2O$) vapor to produce hydrogen ($H_2$) gas is beneficial by increasing the amount of hydrogen ($H_2$) gas in the exhaust gas 114 from dedicated EGR cylinder 156. The WGS catalyst performance is highly dependent on exhaust temperature, and the amount of hydrogen ($H_2$) gas exiting the WGS catalyst is dependent on the amount entering and the amount created. The amount of hydrogen ($H_2$) gas entering the WGS catalyst is a function of the fuel, the dedicated EGR cylinder air/fuel ratio and spark timing. The amount of hydrogen ($H_2$) gas created is therefore dependent on exhaust gas temperature and the amount of carbon monoxide (CO) gas in the inlet exhaust. It is possible to manipulate both with the dedicated EGR cylinder air/fuel ratio. Therefore, for a given operating condition, the dedicated EGR cylinder air/fuel ratio may be controlled to increase the amount of hydrogen ($H_2$) gas exiting the WGS catalyst. Examples of WGS catalysts may include iron oxides ($Fe_3O_4$) or other transition metals and transition metal oxides.

After being mixed in mixer 112, air/exhaust gas mixture 130 may then flow in passage 106 to cooler 132 (e.g. heat exchanger) to remove heat therefrom and correspondingly increase the density thereof. In the cooler 132, the air/exhaust gas mixture 130 is preferably cooled to a temperature in a range of 30° C. to 60° C.

After being cooled by cooler 132, air/exhaust gas mixture 130 may then flow to an intake flow restrictor 134, such as an intake throttle valve (a mechanism by which a flow of the air/exhaust gas mixture 130 is managed by restriction or obstruction) configured to restrict the volumetric flow and amount (mass) of air/exhaust gas mixture 130 provided to cylinders 150, 152, 154 and 156. The intake throttle valve may more particularly comprise a butterfly valve that restricts the flow and amount of air/exhaust gas mixture 130 entering the intake manifold 136 and ultimately provided to cylinders 150, 152, 154 and 156. Intake flow restrictor 134 may be considered to be a primary flow restrictor in that it may similarly restrict the flow of the air/exhaust gas mixture 130 to all of cylinders 150, 152, 154 and 156.

Intake flow restrictor 134 may be located at the entrance of intake manifold 136. Intake manifold 136 may comprise a plenum 138 through which the air/exhaust gas mixture 130 may flow to a plurality of intake passages/runners 140, shown with one passage/runner 140 dedicated to each cylinder 150-156. Each passage/runner 140 may then feed the air/exhaust gas mixture 130 directly into an intake port 142 (shown by dotted lines) of a cylinder head 144, shown with one port 142 dedicated to each cylinder 150-156.

After entering cylinders 150-156, the air/exhaust gas mixture 130 may be ignited by an igniter (not shown) and combust therein. After combustion of the air/exhaust gas mixture 130 within cylinders 150-156, untreated exhaust gas 114 from cylinders 150, 152 and 154 may flow through exhaust ports 160 of cylinder head 144 and exhaust passages/runners 162 of exhaust manifold 170, shown with exhaust ports 160 and one passage/runner 162 dedicated to each cylinder 150-154, and then be collected in collector 164.

From collector 164, untreated exhaust gas 114 may then flow through turbine 176, which may turn intake compressor 108 by shaft 178. After turbine 176, untreated exhaust gas 114 may flow through exhaust passage 182 to catalytic converter 184 to be treated therein before being expelled from exhaust system 190 and into the atmosphere. Catalytic converter 184 may comprise a three-way catalytic converter (TWC). In other words, a catalytic converter which performs the following:

(1) reduction of nitrogen oxides to nitrogen and oxygen by the reaction:

$$2NO_x \rightarrow xO_2+N_2 \quad \text{(Eq 3)}$$

(2) oxidation of carbon monoxide to carbon dioxide by the reaction:

$$2CO+O_2 \rightarrow 2CO_2 \quad \text{(Eq 4)}$$

(3) oxidation of unburnt hydrocarbons (HC) to carbon dioxide and water by the reaction:

$$C_xH_{2x+2} + \left[\frac{3x+1}{2}\right]O_2 \rightarrow xCO_2 + (x+1)H_2O \quad \text{(Eq 5)}$$

To control the air/fuel ratio, untreated exhaust gas 114 from cylinders 150, 152 and 154 may be sampled by an exhaust gas oxygen (EGO) sensor 166, which may more particularly comprise a heated exhaust gas oxygen (HEGO) sensor, while untreated exhaust gas 114 from cylinder 156 may be sampled by an exhaust gas oxygen (EGO) sensor 168, which may more particularly comprise a universal exhaust gas oxygen (UEGO) sensor.

To control the mass and volumetric flow rate of the air/exhaust gas mixture 130 entering dedicated EGR cylinder 156, the portion of the intake passage 146 dedicated to cylinder 156 may include an intake charge flow restrictor 148, such as a throttle valve, configured and arranged to restrict the flow and amount of air/exhaust gas mixture 130 entering cylinder 156 without restricting the flow and amount of air/exhaust gas mixture 130 entering remaining cylinders 150, 152 or 154. The throttle may more particularly comprise a butterfly valve that restricts the amount of air/exhaust gas mixture 130 entering cylinder 156.

Flow restrictor 148 may be considered to be a secondary flow restrictor in that it may restrict the flow of the air/exhaust gas mixture 130 to a particular cylinder, here cylinder 156, as opposed to all the cylinders, after the air/exhaust gas mixture 130 has flowed past primary flow restrictor 134. Flow restrictor 148 may be used in conjunction with intake/exhaust valves, fuel injectors and engine controller 180 of engine 100 to operate or otherwise control dedicated EGR cylinder 156 at the same or different air/fuel ratio than cylinders 150, 152 and 154. Further, each cylinder 150-156 may be independently operated at an air/fuel ratio which is greater than (rich), equal to, or less than (lean) a stoichiometric ratio for the air and fuel.

As shown in FIG. 1, flow restrictor 148 may be located on the intake side of cylinder 156 for intake restriction. Flow restrictor 148 may be attached to the intake manifold 136, or arranged between the intake manifold 136 and the cylinder head 144.

As flow restrictor 148 may be at least partially closed, the flow and amount of air/exhaust gas mixture 130 entering cylinder 156 may be decreased. Simultaneously, the air/exhaust gas mixture 130 entering cylinders 150, 152 and 154 may be increased, provided flow restrictor 134 remains unchanged. Thus, the flow and amount of the air/exhaust gas mixture 130 entering cylinder 156 may be inversely related to the flow and amount of the air/exhaust gas mixture 130 entering cylinders 150, 152 and 154. That is, as the flow and amount of the air/exhaust gas mixture 130 entering cylinder 156 may be decreased, the flow and amount of the air/exhaust gas mixture 130 entering cylinders 150, 152 and 154 may be increased, and vice-versa.

As indicated above, without the use of flow restrictor 148, the engine 100 in FIG. 1 may be understood to have a maximum "25% dedicated EGR content" because the exhaust gas expelled from each cylinder 150-156 may be understood to have substantially the same volume, and one of the four cylinders, cylinder 156, has 90-100% by volume of its exhaust gas redirected to the intake manifold 136.

However, with the use of flow restrictor 148, the volume of exhaust gas expelled from cylinder 156 may now be varied by restricting the amount of air/exhaust gas 130 which is consumed by cylinder 156 such as the engine 100 may provide, for example, between 0.1% and 25% dedicated EGR. By decreasing the flow and amount of air/exhaust gas 130 which is consumed by cylinder 156, the flow and amount of untreated exhaust gas 114 expelled from cylinder 156 and routed/processed through EGR loop 118 to air intake system 110 may be correspondingly decreased, which will decrease the amount of treated exhaust gas 114 provided to the cylinders 150, 152, 154 and 156. Restriction of untreated exhaust gas 114 expelled from cylinder 156 may be particularly necessary if the quantity of treated exhaust gas 114 adversely effects engine performance.

If dedicated EGR cylinder 156 is operated fuel rich, particularly with use of the secondary fuel, and/or exhaust gas 114 is processed through water gas shift (WGS) catalyst, a relatively significant amount of hydrogen ($H_2$) gas and carbon monoxide (CO) gas may be formed, both of which may promote increased EGR tolerance by increasing burn rates, increasing the dilution limits of the mixture and reducing quench distances. In addition, the engine 100 may perform better at knock limited conditions, such as improving low speed peak torque results, due to increased EGR tolerance and the knock resistance provided by hydrogen ($H_2$) and carbon monoxide (CO). Also, while the EGR tolerance of the engine 100 may now increase, the overall fuel consumption may decrease.

While a water gas shift catalyst may result in production of hydrogen ($H_2$) gas, the water-gas shift catalyst exchanges carbon monoxide (CO) gas for hydrogen ($H_2$) gas and carbon dioxide ($CO_2$) gas, meaning that any hydrogen ($H_2$) gas produced results in a loss of combustible carbon monoxide (CO) gas and a gain of incombustible carbon dioxide ($CO_2$) gas, which does not provide the same level of combustion benefit as hydrogen ($H_2$).

Furthermore, the water-gas shift reaction is mildly exothermic, meaning energy is released as the reaction progresses, and thus energy is lost through the process. More particularly, for an engine system with a traditional low level EGR loop, a heat exchanger is generally utilized to reduce the temperature of the EGR feed prior to mixing with intake air. This heat is typically rejected to the engine coolant, and is then subsequently rejected to the ambient environment via the radiator. Similarly, in a gasoline D-EGR application, the energy released during the exothermic water-gas shift reaction is rejected via the same process, meaning that the energy produced by the reaction is not used in a useful manner. As a result, it may be understood that the energy content of hydrogen ($H_2$) gas created is slightly less than the energy content of the carbon monoxide (CO) gas consumed.

Figure 3:
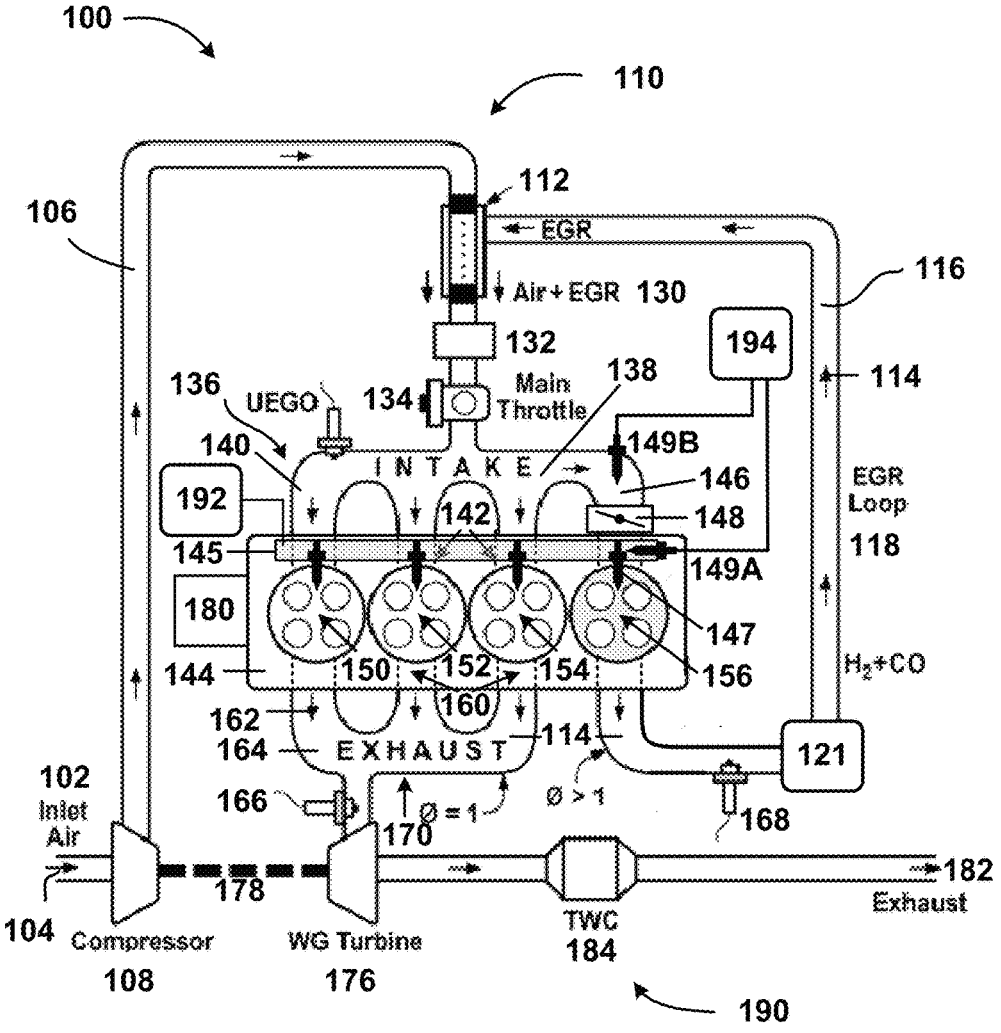
FIG. 3 is a schematic representation of an internal combustion engine which may utilize fuel from two different sources, and include an EGR apparatus comprising a steam hydrocarbon reformer according to a second embodiment of the present disclosure.

Alternatively, in another embodiment as shown in FIG. 3, to increase the quantity of hydrogen ($H_2$) gas in exhaust gas 114 after leaving the dedicated EGR cylinder 156, prior to entering mixer 112 the untreated exhaust gas 114 may enter a steam hydrocarbon reformer 121 within the EGR feedback loop 118. Upon entering the steam hydrocarbon reformer 121, one or more components of the exhaust gas 114 may react with water ($H_2O$) vapor using a steam reformation reaction (SRR) with a suitable steam reformation (SR) catalyst. More particularly, with the SRR reaction, hydrocarbons (HC) which may exist in the exhaust gas 114 after passing through dedicated EGR cylinder 156, particularly due to the dedicated EGR cylinder 156 being operated fuel rich (i.e. phi ($\phi$) is greater than 1.0), may react with water ($H_2O$) vapor to produce carbon monoxide (CO) gas and hydrogen ($H_2$) gas according to the following reaction:

$$C_nH_m + nH_2O \rightarrow nCO + (n+m/2)H_2 \quad \text{(Eq 6)}$$

As shown above, use of a steam reformation reaction with a steam reformation catalyst contained in steam hydrocarbon reformer 121 simultaneously produces carbon monoxide (CO) gas and hydrogen ($H_2$) gas from unburnt hydrocarbon (HC) gas and water vapor in the untreated exhaust gas 114. Thus, reacting a hydrocarbon (HC) gas and water vapor in the untreated exhaust gas 114 from dedicated EGR cylinder 156 to produce carbon monoxide (CO) gas and hydrogen ($H_2$) gas is beneficial by increasing the amount of carbon monoxide (CO) gas and hydrogen ($H_2$) gas in the untreated exhaust gas 114 from dedicated EGR cylinder 156.

The steam reformation catalyst may comprise nickel (Ni) as the active metal. For example, the steam reformation catalyst may comprise a Ni-M composition, where M=gold (Au), silver (Ag), tin (Sn), copper (Cu), cobalt (Co), molybdenum (Mo), iron (Fe), gadolinium (Gd) or boron (B). Apart from such Ni-M compositions, one may also use palladium (Pd) or platinum (Pt) as the steam reformation catalyst. A particularly preferred catalyst is nickel or palladium. Preferably, the steam reformation reaction is carried out at temperatures at or above 500° C.

Untreated exhaust gas 114 entering steam hydrocarbon reformer 121 preferably may have a temperature in a range of 400° C. to 800° C., and be exposed to a pressure in a range of 14.7 psia to 44 psia. It is generally desirable to maintain exhaust temperatures as high as possible to increase production of carbon monoxide (CO) gas and hydrogen ($H_2$) gas from a hydrocarbon (HC) gas. As such, for D-EGR applications, one particular placement of the steam hydrocarbon reformer 121 is as close to the exhaust port 160 as possible, so that the temperature of the exhaust gas 114 entering the steam hydrocarbon reformer 121 is as high as possible.

The amount of unburned hydrocarbon (HC) gas from dedicated EGR cylinder 156, as well as the amount of carbon monoxide (CO) gas and hydrogen ($H_2$) gas created in dedicated EGR cylinder 156, and subsequently entering the steam hydrocarbon reformer 120 is a function of the dedicated EGR cylinder air/fuel ratio and spark timing. For example, if dedicated EGR cylinder 156 is operated fuel rich of stoichiometric A/F (air/fuel) ratio, a relatively significant amount of carbon monoxide (CO) and hydrogen ($H_2$) may be formed prior to the use of the hydrocarbon reformer 121.

The amount of carbon monoxide (CO) gas and hydrogen ($H_2$) gas further created in the hydrocarbon reformer 121 is dependent on exhaust gas temperature and the amount of hydrocarbon or methane ($CH_4$) gas in the untreated exhaust gas 114 entering the reformer 121. Thus, performance of the steam reformation catalyst is dependent on exhaust gas temperature, with the amount of carbon monoxide (CO) gas and hydrogen ($H_2$) gas exiting the steam hydrocarbon reformer 121 being dependent on the amount existing prior to use of the steam hydrocarbon reformer 121 and the amount created in the steam hydrocarbon reformer 121.

Given that the hydrocarbon steam reformation reaction produces carbon monoxide (CO) gas and hydrogen ($H_2$) gas simultaneously, which are both combustible, the benefits of carbon monoxide (CO) gas and hydrogen ($H_2$) gas with respect to octane number and burning velocity can be realized from the steam reformation reaction. Generation of both carbon monoxide (CO) gas and hydrogen ($H_2$) gas for the EGR stream may be understood to have a positive impact on the charge properties of the EGR stream. More particularly, the combination and co-existence of carbon monoxide (CO) gas and hydrogen ($H_2$) gas in the EGR stream may improve flame speed and combustion stability, as well as improve knock and EGR tolerance.

Furthermore, the steam reformation reaction is endothermic, meaning energy is put into the reaction and thus the heating value (or energy content) of the formed carbon monoxide (CO) gas and hydrogen ($H_2$) gas mixture is greater than the heating value of the consumed methane ($CH_4$) gas. Stated another way, since the hydrocarbon steam reformation reaction is endothermic, waste heat energy (from the exhaust gas) is used to produce carbon monoxide (CO) gas and hydrogen ($H_2$) gas from hydrocarbons, thereby increasing the final energy content of the mixture. Essentially, the steam reformation catalyst functions as a chemical waste heat recuperative device, which makes use of exhaust energy (that would otherwise be rejected to the environment) in order to increase the energy content of the fuel.

For operation of steam reformation catalysts in an environment containing appreciable amounts of sulfur which may poison the catalyst, it may be necessary to utilize a regenerable or replaceable sulfur trap upstream of the steam reformation catalyst in order prevent sulfation of the steam reformation catalyst. Natural gas streams are typically very free of sulfur, and as such may allow for effective use of regenerable or replaceable sulfur traps with satisfactory replacement or regeneration intervals.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A method of operating an internal combustion engine having a plurality of cylinders, the method comprising:

operating the engine as a spark-ignition engine;

operating the engine with at least one of the cylinders of the engine as a dedicated exhaust gas recirculation (EGR) cylinder, wherein 90%-100% by volume of exhaust gas expelled from the dedicated EGR cylinder is recirculated to an intake system of the engine, the intake system including a dedicated EGR cylinder intake charge flow restrictor configured to restrict flow of a combustible charge to the dedicated EGR cylinder without restricting flow of the combustible charge to other cylinders of the plurality of cylinders which are not dedicated EGR cylinders;

mixing exhaust gas expelled from the dedicate EGR cylinder with air in the intake system of the engine to provide a mixture of exhaust gas and air;

providing a first hydrocarbon fuel from a first fuel tank, wherein the first hydrocarbon fuel is gasoline;

providing a second hydrocarbon fuel from a second fuel tank;

introducing a charge comprising the first hydrocarbon fuel, the second hydrocarbon fuel and the mixture of exhaust gas and air to the dedicated EGR cylinder, the second hydrocarbon fuel introduced to the dedicated EGR cylinder from a second fuel injector arranged in the intake system downstream of the dedicated EGR cylinder charge flow restrictor;

igniting the charge in the dedicated EGR cylinder;

expelling exhaust gas from the dedicated EGR cylinder; and recirculating the exhaust gas to the intake system of the engine.

2. The method of claim 1 wherein:

the second hydrocarbon fuel has a hydrogen to carbon (H:C) atomic ratio greater than the first hydrocarbon fuel.

3. The method of claim 2 wherein:

the second hydrocarbon fuel is natural gas.

4. The method of claim 2 wherein:

the second hydrocarbon fuel is liquefied petroleum gas.

5. The method of claim 1 wherein:

the second hydrocarbon fuel is added to the charge by a fuel injector located in an intake manifold of the engine or intake port of the engine.

6. The method of claim 1 further comprising:

introducing a charge comprising the first hydrocarbon fuel and the mixture of exhaust gas and air to each of the remaining cylinders; and wherein the charge introduced to each of the remaining cylinders does not include the second hydrocarbon fuel.

7. The method of claim 1 further comprising:

igniting the charge in each of the remaining cylinders;

expelling exhaust gas from each of the remaining cylinders; and treating the exhaust gas expelled from each of the remaining cylinders with a catalytic converter.

8. The method of claim 1 wherein:

during the step of recirculating the exhaust gas to the intake system of the engine, the exhaust gas is routed through a water gas shift reactor that converts carbon monoxide and water to carbon dioxide and hydrogen; and the exhaust gas undergoes a reaction in the water gas shift reactor, wherein the reaction increases a quantity of hydrogen contained in the exhaust gas.

9. The method of claim 1 wherein:

during the step of recirculating the exhaust gas to the intake system of the engine, the exhaust gas is routed through a steam hydrocarbon reformer that converts hydrocarbon and water to carbon monoxide and hydrogen; and the exhaust gas undergoes a reaction in the steam hydrocarbon reformer, wherein the reaction increases a quantity of carbon monoxide and hydrogen contained in the exhaust gas.

10. An internal combustion engine, the engine comprising:

a spark-ignition internal combustion engine having a plurality of cylinders;

at least one of the cylinders of the engine arranged as a dedicated exhaust gas recirculation (EGR) cylinder, wherein 90%-100% by volume of exhaust gas expelled from the dedicate EGR cylinder is recirculated to an intake system of the engine;

a plurality of first fuel injectors to receive a first hydrocarbon fuel from a first fuel tank, wherein each of first fuel injectors is arranged to provide the first hydrocarbon fuel to one of the cylinders, wherein the first hydrocarbon fuel is gasoline;

a second fuel injector to receive a second hydrocarbon fuel from a second fuel tank, wherein the second fuel injector is arranged to provide the second hydrocarbon fuel to the dedicated EGR cylinder;

the intake system including a dedicated EGR cylinder intake charge flow restrictor configured to restrict flow of a combustible charge to the dedicated EGR cylinder without restricting flow of the combustible charge to other cylinders of the plurality of cylinders which are not dedicated EGR cylinders; and the second fuel injector arranged to provide the second hydrocarbon fuel to the dedicated EGR cylinder is arranged in the intake system downstream of the dedicated EGR cylinder intake charge flow restrictor.

11. The internal combustion engine of claim 10 wherein:

the engine is arranged such that the second hydrocarbon fuel is only provided to the dedicated EGR cylinder and not the remaining cylinders.

12. The internal combustion engine of claim 10 wherein:

the exhaust gas expelled from the dedicate EGR cylinder is recirculated to the intake system of the engine in an EGR feedback loop; and the engine further comprises a water gas shift reactor located in the EGR feedback loop to convert carbon monoxide and water to carbon dioxide and hydrogen such that the exhaust gas expelled from the dedicated EGR cylinder is routed through the water gas shift reactor.

13. The internal combustion engine of claim 10 wherein:

the exhaust gas expelled from the dedicated EGR cylinder is recirculated to the intake system of the engine in an EGR feedback loop; and the engine further comprises a steam hydrocarbon reformer located in the EGR feedback loop to convert hydrocarbon and water to carbon monoxide and hydrogen such that the exhaust gas expelled from the dedicated EGR cylinder is routed through the steam hydrocarbon reformer.

14. The internal combustion engine of claim 10 wherein:

the first fuel injectors are arranged to direct the first fuel directly into each cylinder.

15. The internal combustion engine of claim 10 wherein:

the second fuel injector is arranged in an intake port of the dedicated EGR cylinder and/or an intake passage of the dedicated EGR cylinder.

16. The internal combustion engine of claim 15 wherein:

the intake port is within a cylinder head of the engine.

17. The internal combustion engine of claim 15 wherein:

the intake passage is located within an intake manifold of the engine.

18. The internal combustion engine of claim 10 wherein:

the first fuel tank is a gasoline fuel tank and the second fuel tank is a natural gas fuel tank or a liquefied petroleum gas fuel tank.

19. A motor vehicle comprising:

a spark-ignition internal combustion engine having a plurality of cylinders;

at least one of the cylinders of the engine arranged as a dedicated exhaust gas recirculation (EGR) cylinder, wherein 90%-100% by volume of exhaust gas expelled from the dedicated EGR cylinder is recirculated to an intake system of the engine;

a plurality of first fuel injectors to receive a first hydrocarbon fuel from a first fuel tank of the motor vehicle, wherein each of first fuel injectors is arranged to provide the first hydrocarbon fuel to one of each of the cylinders, wherein the first hydrocarbon fuel is gasoline;

a second fuel injector to receive a second hydrocarbon fuel from a second fuel tank of the motor vehicle, wherein the second fuel injector is arranged to provide the second hydrocarbon fuel to the dedicated EGR cylinder;

the intake system including a dedicated EGR cylinder intake charge flow restrictor configured to restrict flow of a combustible charge to the dedicated EGR cylinder without restricting flow of the combustible charge to other cylinders of the plurality of cylinders which are not dedicated EGR cylinders; and the second fuel injector arranged to provide the second hydrocarbon fuel to the dedicated EGR cylinder is arranged in the intake system downstream of the dedicated EGR cylinder intake charge flow restrictor.

20. The internal combustion engine of claim 10 wherein:

the dedicated EGR cylinder intake charge flow restrictor is attached to an intake manifold of the engine or arranged between the intake manifold of the intake manifold and a cylinder head of the engine; and the second fuel injector is located in an intake port of the cylinder head of the engine.

* * * * *